US010650729B2

(12) United States Patent
Qian et al.

(10) Patent No.: US 10,650,729 B2
(45) Date of Patent: May 12, 2020

(54) DISPLAY DRIVING CIRCUIT AND A DRIVING METHOD THEREOF, A DISPLAY DRIVING SYSTEM AND A DISPLAY APPARATUS

(71) Applicant: BOE Technology Group Co., Ltd., Beijing (CN)

(72) Inventors: Chenfei Qian, Beijing (CN); Zhicheng Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 16 days.

(21) Appl. No.: 15/925,044

(22) Filed: Mar. 19, 2018

(65) Prior Publication Data

US 2019/0130816 A1 May 2, 2019

(30) Foreign Application Priority Data

Oct. 31, 2017 (CN) ..... 2017 1 1053073

(51) Int. Cl.
*G09G 3/22* (2006.01)
*G09G 3/20* (2006.01)

(52) U.S. Cl.
CPC ..... *G09G 3/22* (2013.01); *G09G 3/20* (2013.01); *G09G 3/2074* (2013.01); *G09G 3/2003* (2013.01); *G09G 2310/0264* (2013.01); *G09G 2310/08* (2013.01); *G09G 2350/00* (2013.01); *G09G 2370/08* (2013.01); *G09G 2370/14* (2013.01)

(58) Field of Classification Search
None
See application file for complete search history.

(56) References Cited

U.S. PATENT DOCUMENTS

2004/0119730 A1* 6/2004 Ham ..... G09G 3/3648 345/692
2009/0160829 A1* 6/2009 Kataoka ..... G06F 7/584 345/204
2011/0032421 A1* 2/2011 Kota ..... G09G 5/18 348/500

FOREIGN PATENT DOCUMENTS

CN 101800038 A 8/2010
CN 201854360 U 6/2011
CN 202772998 U 3/2013
CN 103581600 A 2/2014

OTHER PUBLICATIONS

First Office Action, including Search Report, for Chinese Patent Application No. 201711053073.7, dated Jan. 13, 2020, 17 pages.

* cited by examiner

*Primary Examiner* — Nicholas J Lee
(74) *Attorney, Agent, or Firm* — Westman, Champlin & Koehler, P.A.

(57) ABSTRACT

Embodiments of the present disclosure provide a display driving circuit, a driving method thereof, a display driving system and a display apparatus. The display driving circuit includes a processor and a source driver. The processor is electronically connected to the source driver and configured to receive a low voltage differential signal and to output a data signal for sub-pixels of odd-numbered pixel units and a data signal for sub-pixels of even-numbered pixel units among the low voltage differential signal simultaneously to the source driver progressively.

13 Claims, 5 Drawing Sheets

DISPLAY DRIVING CIRCUIT AND A DRIVING METHOD THEREOF, A DISPLAY DRIVING SYSTEM AND A DISPLAY APPARATUS

CROSS-REFERENCE TO RELATED APPLICATION(S)

This application claims the benefit of Chinese Patent Application No. 201711053073.7, filed on Oct. 31, 2017, the entire contents of which are incorporated herein by reference.

TECHNICAL FIELD

The disclosure relates to a field of display technology, and in particular, to a display driving circuit and a driving method thereof, a display driving system and a display apparatus.

BACKGROUND

TFT-LCD (Thin Film Transistor Liquid Crystal Display) or Organic Light Emitting Diode (OLED) displays, as a flat panel display device, have advantages of small size, low power consumption, no radiation and a relatively low cost and the like. Thus, they have been increasingly used in a high performance display field.

The display device includes a display panel and a driving chip electronically connected to the display panel. During a process of displaying images, the driving chip may output a data signal and a control signal to the display panel, so that the display panel displays according to the data signal under the control of the control signal. With a continuous improvement to the resolution of the display panel, there is also an increasing requirement on the transmission rate of the data signal. The conventional driving chip has the problem that the data signal may be misaligned due to a slow data transmission rate, which may lead to an abnormal display.

SUMMARY

Embodiments of the present disclosure provide a display driving circuit and a driving method thereof, a display driving system and a display apparatus.

According to an aspect of the embodiments of the present disclosure, there is provided a display driving circuit comprising: a source driver; and a processor, electronically connected to the source driver and configured to receive a low voltage differential signal and to output a data signal for sub-pixels of odd-numbered pixel units among the low voltage differential signal and a data signal for sub-pixels of even-numbered pixel units among the low voltage differential signal simultaneously to the source driver progressively.

For example, the display driving circuit may further comprise a first storage electronically connected to the processor and the source driver and configured to store the low voltage differential signal, wherein the processor is further configured to address the data signal for the sub-pixels of the odd-numbered pixel units among the low voltage differential signal stored in the first storage progressively.

For example, the display driving circuit may further comprise a second storage electronically connected to the processor and the source driver, wherein the second storage is configured to store the low voltage differential signal, and the processor is further configured to address the data signal for the sub-pixels of the even-numbered pixel units among the low voltage differential signal stored in the second storage progressively.

For example, each pixel unit may comprise three sub pixels with different colors, and the first storage is electronically connected to the source driver through three channels of odd-numbered low voltage differential data lines disposed in parallel, wherein each of the three channels of odd-numbered low voltage differential data lines is configured to receive the data signal for the sub-pixels with one color of the odd-numbered pixel units in a row of pixel units, from the first storage one by one, and to transmit the data signal to the source driver one by one.

For example, each pixel unit may comprise three sub pixels with different colors, and the second storage is electronically connected to the source driver through three channels of even-numbered low voltage differential data lines disposed in parallel, wherein each of the three channels of even-numbered low voltage differential data lines is configured to receive the data signal for the sub-pixels with one color of the even-numbered pixel units in a row of pixel units, from the second storage one by one, and to transmit the data signal to the source driver one by one.

For example, the processor may be implemented as a Field Programmable Gate Array (FPGA) chip.

According to another aspect of the embodiments of the present disclosure, there is provided a display driving system, comprising a main driver and the display driving circuit of any of above examples, wherein the main driver is connected to the processor of the display driving circuit through an interface for a low voltage differential signal.

According to another aspect of the embodiments of the present disclosure, there is provided a display apparatus comprising the display driving system of any of above examples.

For example, the display apparatus may further comprise a display panel, and the display driving circuit in the display driving system is disposed in a non-display area of the display panel.

For example, the display apparatus may further comprise a driving board, and the main driver in the display driving system is disposed on the driving board.

According to another aspect of the embodiments of the present disclosure, there is provided a method of driving the display driving circuit of any of above examples. The method may comprise receiving and storing a low voltage differential signal; and outputting a data signal for sub-pixels of odd-numbered pixel units among the low voltage differential signal and a data signal for sub-pixels of even-numbered pixel units among the low voltage differential signal simultaneously to the source driver progressively.

For example, before outputting the data signals to the source driver but after receiving the low voltage differential signal, the method may further comprise: outputting, a controlling bit signal for removing the data signal for the sub-pixels in a previous row, to the source driver.

For example, the display driving circuit may comprise an odd-numbered low voltage differential data line and an even-numbered low voltage differential data line, and the outputting the data signal to the source driver may comprise: addressing the data signal for sub-pixels of the odd-numbered pixel units among the low voltage differential signal progressively, and outputting, a data signal for the sub-pixels with one color of the odd-numbered pixel units in a row of pixel units, to the source driver through each channel of odd-numbered low voltage differential data line one by one; and simultaneously, addressing the data signal for sub-pixels of even-numbered pixels unit among the low voltage differential signal progressively and outputting, a data signal for the sub-pixels with one color of the even-numbered pixel units in a row of pixel units, to the source driver through each channel of even-numbered low voltage differential data line one by one.

For example, the method may further comprise outputting the controlling bit signal to the source driver in response to detection of a controlling signal for data transmission being at a valid operating level for the controlling signal while a flag signal for operation status being at a valid operating level.

According to another aspect of the embodiments of the present disclosure, there is provided a computer device comprising a processor and a memory, the memory storing a computer program executable by the processor, and when executed by the processor, the computer program causes the processor to implement the method of any of above examples.

According to another aspect of the embodiments of the present disclosure, there is provided a computer readable medium storing instructions that, when executed by a processor, implement the method of any of above examples.

BRIEF DESCRIPTION OF THE DRAWINGS

In order to illustrate embodiments of the present disclosure or the prior art, drawings which are used in the description of the embodiments or the prior art will be briefly described herein. It will be apparent that the drawings in the following description are merely some of embodiments of the present disclosure, those skilled in the art would obtain other drawings in view of the drawings illustrated herein without making a creative effort.

DETAILED DESCRIPTION

The embodiments of the present disclosure will now be described in conjunction with the accompanying drawings in the present disclosure. It will be apparent that the described embodiments are merely part of the embodiments of the present disclosure and not all of the embodiments. All other embodiments obtained by those of ordinary skill in the art without making creative work are within the scope of this disclosure, based on the embodiments of the present disclosure.

It should also be noted that, in this context, terms such as "first," "second," and the like used herein may be used to distinguish one element from another element, which does not require or imply that any such actual relationship or order exists between these entities or operations. Thus, a feature defined by the terms such as "first," "second," and the like may explicitly or implicitly include one or more of the features. In the description of the present disclosure, terms such as "a plurality of" mean two or more unless otherwise specified.

In addition, the term "a valid operating level" refers to a level at which a relevant signal can drive relevant components to perform corresponding operations. In the following embodiments, the description will be made by taking the "valid operating level" as a relatively high level for an example.

In addition, in the description of the embodiments of the present disclosure, terms such as "connected with" or "connected to" may refer to a direct connection between two components or a connection between the two components via one or more other components. Furthermore, these two components can be connected or coupled by wire or wirelessly.

For example, in a display panel with a high resolution, as a number of sub-pixels included in a row of pixel units increases, the time for receiving data by the sub-pixels in the row is limited. In this case, if a driving chip has a low speed for transmitting data signals, an incomplete data transmission may occur in that row, which may cause a misalignment of data signal, further leading to an abnormal display.

Figure 1A:
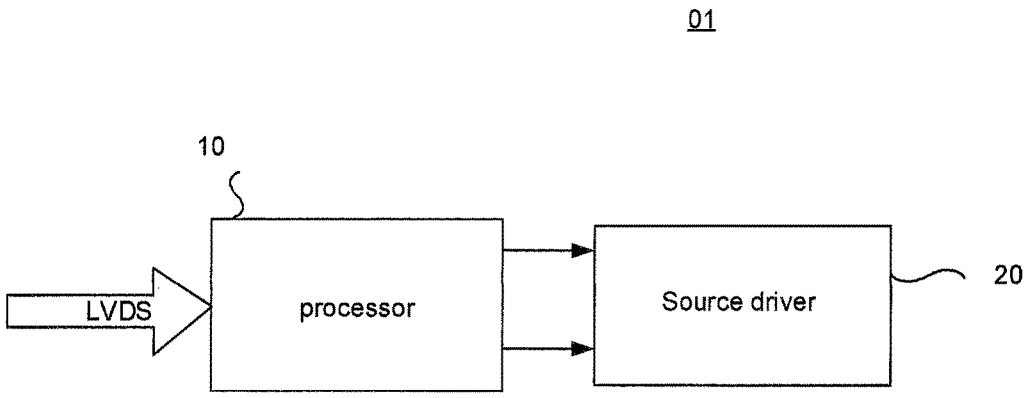
FIG. 1A shows a schematic structural diagram of a display driving circuit according to an embodiment of the present disclosure.

The embodiment of the present disclosure may provide a display driving circuit 01. As shown in FIG. 1A, the display driving circuit 01 according to the embodiment of the present disclosure may comprise a processor 10 and a source driver 20. The processor 10 is electronically connected to the source driver 20 and configured to receive a low voltage differential signal (LVDS) and to output a data signal for sub-pixels of odd-numbered pixel units and a data signal for sub-pixels of even-numbered pixel units among the low voltage differential signal LVDS simultaneously to the source driver progressively.

Figure 1B:
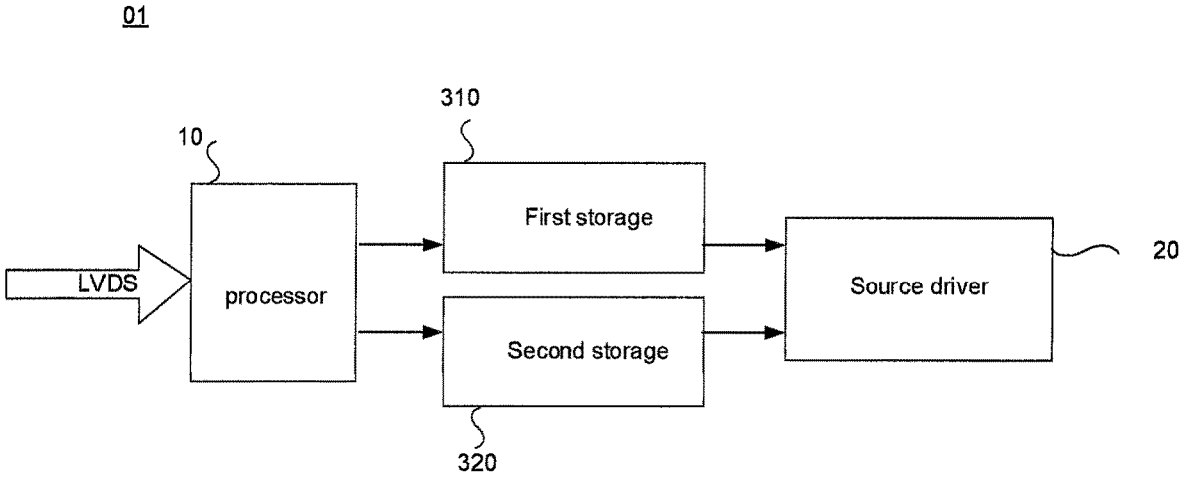
FIG. 1B shows a schematic structural diagram of a display driving circuit according to an embodiment of the present disclosure.

For example, as shown in FIG. 1B, the display driving circuit 01 may further comprise a first storage 310 and a second storage 320 electronically connected to the processor 10 and the source driver 20. The first storage 310 may be configured to store the data signal for the sub-pixels of the odd-numbered pixel units among the low voltage differential signal LVDS, and the second storage 320 may be configured to store the data signal for the sub-pixels of the even-numbered pixel units among the low voltage differential signal LVDS. The processor 10 is further configured to address the data signal for the sub-pixels of the odd-numbered pixel units stored in the first storage 310 progressively and address the data signal for the sub-pixels of the even-numbered pixel units stored in the second storage 320 progressively.

Figure 1C:
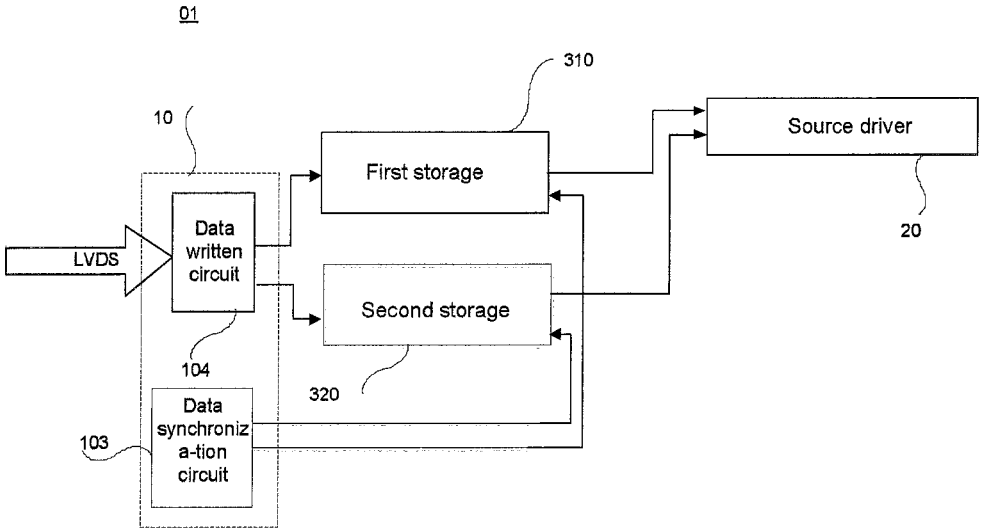
FIG. 1C shows a schematic structural diagram of a display driving circuit according to an embodiment of the present disclosure.

For example, the processor 10 may be implemented as a Field Programmable Gate Array (FPGA) chip. As shown in FIG. 1C, the processor 10 may be implemented by including a data synchronization circuit 103 and a data written circuit 104.

Figure 2:
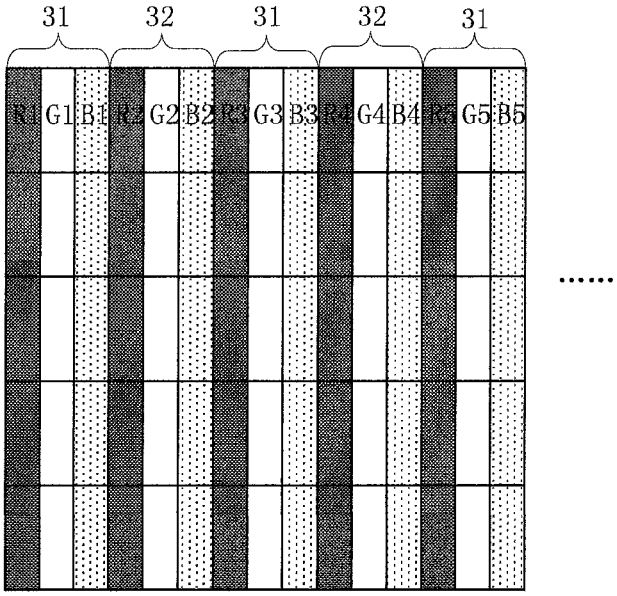
FIG. 2 shows a structural diagram of an arrangement of pixel units in a display panel according to an embodiment of the present disclosure.

Under the control of the data synchronization circuit 103, the data written circuit 104 may receive the low voltage differential signal LVDS, write the data signal for the sub-pixels (as shown in FIG. 2, sub-pixels such as R1, G1, B1, R3, G3, B3 . . . ) of the odd-numbered pixel units 31 among the LVDS (such as, the 8 bit data inputted to the sub-pixel R1 is R10, R11, R12, R13, R14, R15, R16 and R17; and the 8 bit data inputted to the sub-pixel G1 is G10, G11, G12, G13, G14, G15, G16 and G17) to the first storage 310, and write the data signal for the sub-pixels (as shown in FIG. 2, sub-pixels such as R2, G2, B2, R4, G4, B4 . . . ) of the even-numbered pixel units 32 among the LVDS (such as, the 8 bit data inputted to the sub-pixel R2 is R20, R21, R22, R23, R24, R25, R26 and R27; and the 8 bit data inputted to the sub-pixel G2 is G20, G21, G22, G23, G24, G25, G26 and G27) to the second storage 320.

FIG. 2 shows a structural diagram of an arrangement of pixel units in a display panel according to an embodiment of the present disclosure. As shown in FIG. 2, a plurality of pixel units arranged in a matrix form may be disposed in a display area of a display panel. For example, at least three sub-pixels may be included in each pixel unit. For example, each pixel unit may comprise a red (R) sub-pixel, a green (G) sub-pixel, and a blue (B) sub-pixel, or a cyan sub-pixel, a magenta sub-pixel, and a yellow sub-pixel.

For another example, one pixel unit may comprise a red (R) sub-pixel, a green (G) sub-pixel, a blue (B) sub-pixel, and a white (W) sub-pixel.

In the following, for convenience of description, the description is made by taking as an example of including the red (R) sub-pixel, the green (G) sub-pixel and the blue (B) sub-pixel in one pixel unit.

Based on this, the odd-numbered pixel units 31 refer to pixel units located in an odd-numbered column among one row of pixel units. For example, the odd-numbered pixel units 31 described above refers to the pixel units located in the first column, the third column, the fifth column and the like. In this case, the sub-pixels in the odd-numbered pixel units 31 described above, such as, each sub-pixel R1, G1, and B1 in the first column of the pixel unit, may receive a sub data signal transmitted to the source driver 20 from a first storage 101, among the data signal outputted to the source driver 20.

Similarly, the even-numbered pixel units 32 refer to pixel units located in an even-numbered column among one row of pixel units. For example, the even-numbered pixel units 31 described above refers to the pixel units located in the second column, the fourth column, the sixth column and the like. In this case, the sub-pixels in the even-numbered pixel units 31 described above, such as, each sub-pixel R2, G2, and B2 in the second column of the pixel unit, may receive a sub data signal transmitted to the source driver 20 from a second storage 102, among the data signal outputted to the source driver 20.

In addition, the data synchronization circuit 103 is electronically connected to the first storage 310 and the second storage 320. The data synchronization circuit 103 is configured to control the first storage 310 and the second storage 320 to output the data signal synchronously.

Under the control of the data synchronization circuit 103, the first storage 310 and the second storage 320 described above may input the data signals for sub-pixels of the odd-numbered pixel units 31 and the sub-pixels for the even-numbered pixel units 32 to the source driver 20 simultaneously and respectively, which can make the speed for receiving data signals by the sub-pixels in that row as double as it is. Therefore, even for a display panel with a high resolution, which has a large number of sub-pixels in a row of pixel units and a constant scanning time for one row (for example, has a refresh frequency of 60 Hz), the sub-pixels in that row can receive data signals in a short time, since the data signal for the odd-numbered pixel units 31 and the even-numbered pixel units 32 in that row can be written at the same time. Thus, the data signals outputted by the processor 10 can be accurately and completely input into the sub-pixels, ensuring a normal display for the sub-pixel in that row and avoiding an occurrence of an abnormal display.

The structure and working process of the first storage 310 and the second storage 320 described above are described in detail below.

Figure 3:
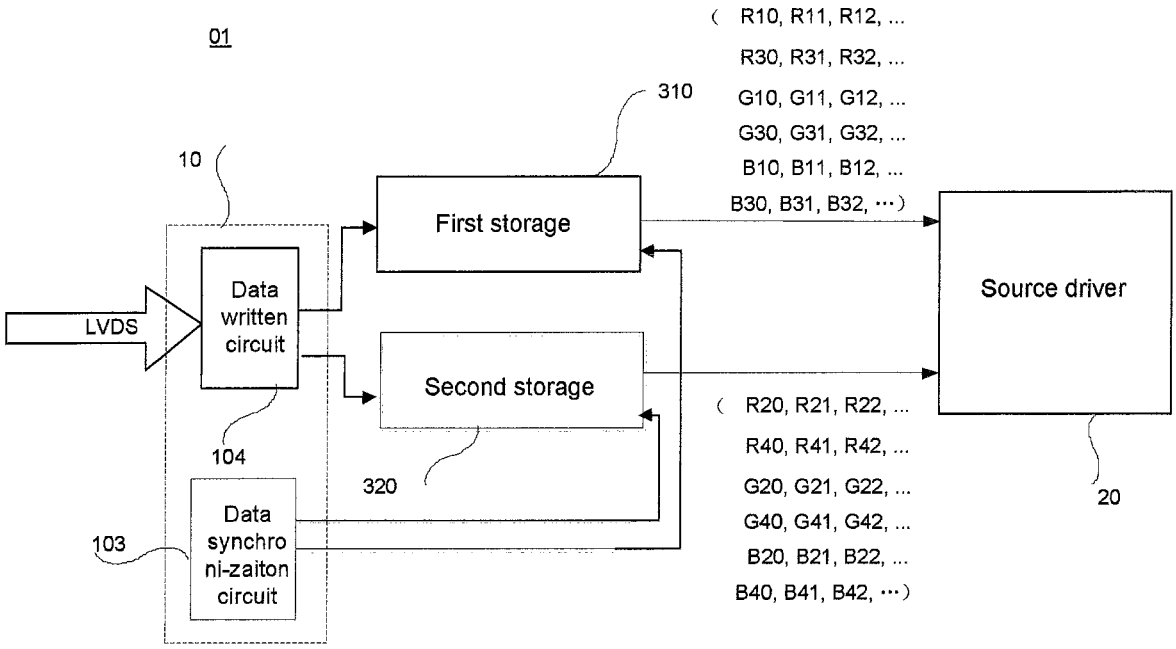
FIG. 3 shows a detailed structural diagram of a first storage and a second storage in FIG. 1C.

As shown in FIG. 3, the first storage 310 may be electronically connected to the data written circuit 104. The first storage 310 is configured to store the above-described LVDS signal.

Under the control of the data synchronization circuit 103, the data signal (for example, R10, R11, R12, R13, R14, R15, R16, R17, R30, R31, R32, R33 . . . ; G10, G11, G12, G13, G14, G15, G16, G17, G30, G31, G32, G33 . . . ; B10, B11, B12, B13, B14, B15, B16, B17, B30, B31, B32, B33 . . . ) for the sub-pixels of the odd-numbered pixel unit 31 among the low voltage differential signal stored in the first storage 310 is addressed progressively.

The first memory cell 310 is further electronically connected to the source driver 20. The first storage 310 is further configured to output the addressed data signal, i.e., the data signal for the sub-pixel of the odd-numbered pixel unit 31 stored in the first storage 310, to the source driver 20 under the control of the data synchronization circuit 103.

In addition, the second storage 320 is connected to the data written circuit 104. The second storage 320 is configured to store an LVDS signal.

Under the control of the data synchronization circuit 103, the data signal (for example, R20, R21, R22, R23, R24, R25, R26, R27, R40, R41, R42, R43 . . . ; G20, G21, G22, G23, G24, G25, G26, G27, G40, G41, G42, G43 . . . B20, B21, B22, B23, B24, B25, B26, B27, B40, B41, B42, B43 . . . ) for the sub-pixels of the even-numbered pixel unit 31 among the low voltage differential signal stored in the second storage 320 is addressed progressively.

The second storage 320 is further electronically connected to the source driver 20. The second storage 320 is further configured to output the addressed data signal, i.e., the data signal for the sub-pixel of the even-numbered pixel unit 32 stored in the second storage 320, to the source driver 20 under the control of the data synchronization circuit 103.

It should be noted that the first storage 310 and the second storage 320 described above may be implemented as various media capable of storing program codes, such as a ROM and a RAM.

Hereinafter, the process of the first storage 310 and the second storage 320 transmitting data to the source driver will be described in detail by taking an example that each pixel unit comprises three sub-pixels with different colors, for example, a red (R) sub-pixel, a green (G) sub-pixel, and a blue (B) sub-pixel.

Figure 4:
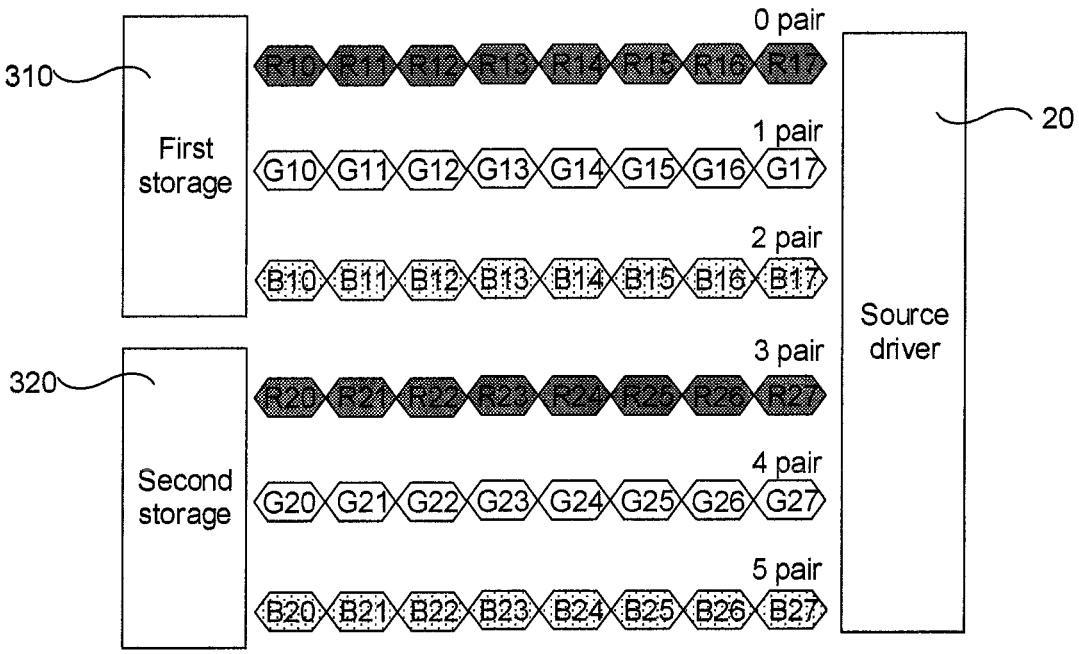
FIG. 4 shows a schematic diagram for the signal transmission between the first storage or the second storage and the source driver in FIG. 3.

As shown in FIG. 4, the first storage 310 is electronically connected to the source driver 20 through three channels of odd-numbered low voltage differential (Mini_LVDS) data lines (0pair, 1pair and 2pair) disposed in parallel, wherein each of the three channels of odd-numbered low voltage differential data lines is configured to receive the data signal for the sub-pixels with one color of the odd-numbered pixel units 31 in a row of pixel units, from the first storage 310 one by one, and to transmit the data signal to the source driver 20 one by one.

In addition, the second storage 320 is electronically connected to the source driver 20 through three channels of even-numbered low voltage differential (Mini_LVDS) data lines (3pair, 4pair and 5pair) disposed in parallel, wherein each of the three channels of even-numbered low voltage differential data lines is configured to receive the data signal for the sub-pixels with one color of the even-numbered pixel units 32 in a row of pixel units, from the second storage 320 one by one, and to transmit the data signal to the source driver 20 one by one.

Taking a display panel with a resolution of 1024×768 as an example, the first storage 310 may transmit data to the source driver 20 through the three channels of odd-numbered low voltage differential (Mini_LVDS) data lines (0pair, 1pair and 2pair) and the second storage 320 may transmit data to the source driver 20 through the three channels of even-numbered low voltage differential (Mini_LVDS) data lines (3pair, 4pair and 5pair), as shown in Table 1.

TABLE 1

| | 6 pairs | Data transmitted through a channel of Mini_LVDS data line |
|---|---|---|
| odd-numbered pixel units | 0 | R10, R11, R12, R13, R14, R15, R16, R17, R30, R31, R32, R33 . . . R10230, R10231 . . . R10237 |
| | 1 | G10, G11, G12, G13, G14, G15, G16, G17, G30, G31, G32, G33 . . . G10230, G10231 . . . G10237 |
| | 2 | B10, B11, B12, B13, B14, B15, B16, B17, B30, B31, B32, B33 . . . B10230, B10231 . . . B10237 |
| even-numbered pixel units | 3 | R20, R21, R22, R23, R24, R25, R26, R27, R40, R41, R42, R43 . . . R10240, R10241 . . . R10247 |
| | 4 | G20, G21, G22, G23, G24, G25, G26, G27, G40, G41, G42, G43 . . . G10240, G10241 . . . G10247 |
| | 5 | B20, B21, B22, B23, B24, B25, B26, B27, B40, B41, B42, B43 . . . B10240, B10241 . . . B10247 |

The data received by each sub pixel is an 8 bit data. For example, the data signal received by the red sub-pixel R1 in the odd-numbered pixel unit 31 are R10, R11, R12, R13, R14, R15, R16, and R17.

It should be noted that a data line (not shown in the figure) for transmitting a timing signal may be further disposed between the first storage 310 or the second storage 320 and the source driver 20. The timing signal may control the data signal transmission in each Mini_LVDS data line described above.

In view of above, when the first storage 310 and the second storage 320 transmit data to the source driver 20 simultaneously, the 6 channel (6 pairs) of Mini_LVDS data lines disposed in parallel can perform data transmission simultaneously, so that sub-pixels with the same color of the odd-numbered pixel units 31 and the even-numbered pixel units 32 adjacent to each other in the same row can simultaneously receive data signals for displaying. For example, while the red sub-pixel R1 in the odd-numbered pixel unit 31 sequentially receives the data signal of R10, R11, R12, R13, R14, R15, R16 and R17, the red sub-pixel R2 in the even-numbered pixel unit 32 adjacent to the odd-numbered pixel unit 31 may receives the data signal of R20, R21, R22, R23, R24, R25, R26 and R27.

Compared with a 3-pair mode as shown in Table 2, the 6-pair mode has a higher efficiency for data transmission. Therefore, for a display panel with a higher resolution, the data signal for sub-pixels in one row can be written into each sub-pixel completely and accurately in a certain scanning time.

TABLE 2

| | 3 pairs | Data transmitted through a channel of Mini_LVDS data line |
|---|---|---|
| all pixels | 0 | R10, R11, R12, R13, R14, R15, R16, R17, R20, R21, R22, R23 . . . R10240, R10241 . . . R10247 |
| | 1 | G10, G11, G12, G13, G14, G15, G16, G17, G20, G21, G22, G23 . . . G10240, G10241 . . . G10247 |
| | 2 | B10, B11, B12, B13, B14, B15, B16, B17, B20, B21, B22, B23 . . . B10240, B10241 . . . B10247 |

Figure 5:
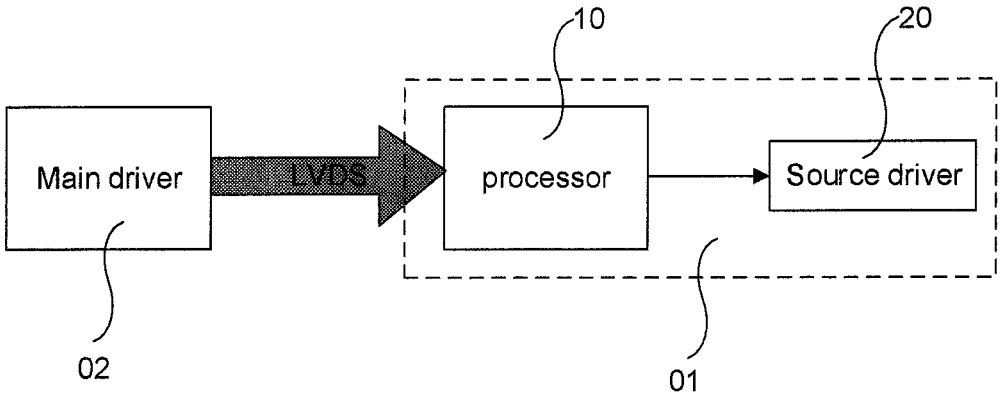
FIG. 5 shows a schematic structural diagram of a display driving system according to an embodiment of the present disclosure.
Figure 6:
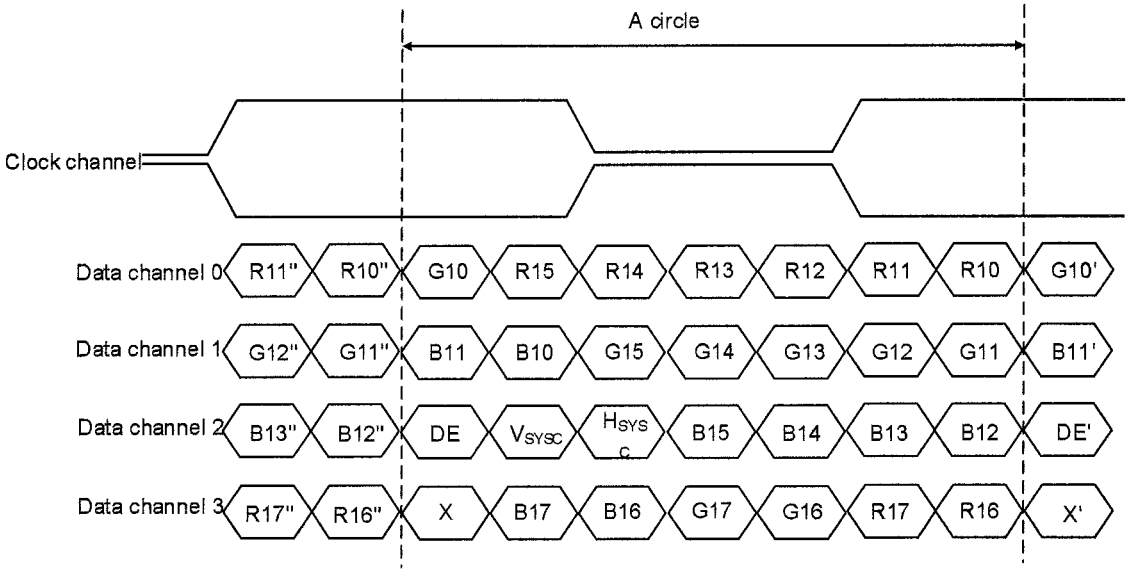
FIG. 6 shows a schematic diagram of the transmission of the low voltage differential signal in FIG. 5.

The embodiments of the present disclosure provide a display driving system. As shown in FIG. 5, the display driving system according to an embodiment of the present disclosure may include a main driver 02 and the display driving circuits 01 of any of embodiments described above.

In addition, the display apparatus further includes a display panel. The display driving circuit 01 in the display driving system is disposed in a non-display area of the display panel. The non-display area of the display panel is an area on the peripheral of an area where the pixel unit is located on the display panel.

The display apparatus may further include a driving board (not shown). The main driver 02 in the display driving system is disposed on the driving board.

The above display apparatus has the same technical effects as the display driving system provided by the foregoing embodiments, and details will not be described here.

In addition, in the embodiments of the present disclosure, the above display apparatus may include a liquid crystal display apparatus or an organic light emitting diode display apparatus. For example, the display apparatus may be any product or component having a display function such as a display, a television, a digital frame, a cell phone or a tablet.

Figure 7:
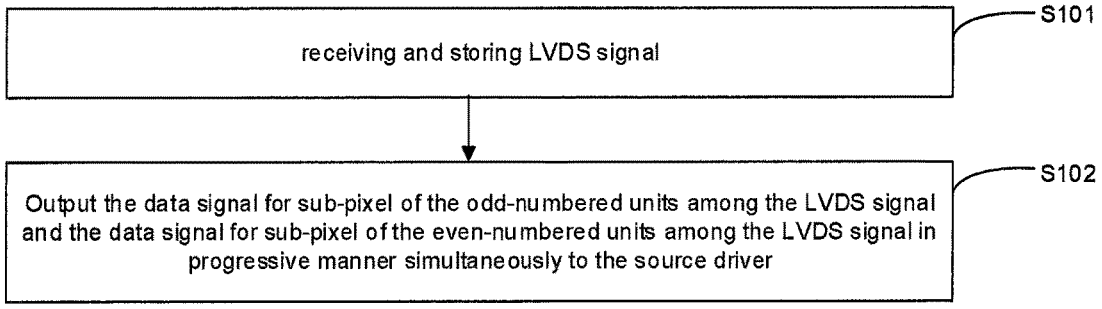
FIG. 7 shows a flowchart of a method of driving the display driving circuit according to an embodiment of the present disclosure.

The embodiments of the present disclosure further provide a method of driving any one of the display driving circuits as described above. As shown in FIG. 7, the method may include following steps.

In step S101, the LVDS signal is received and stored.

For example, the processor 10 receives the LVDS signal and stores it in the first storage 310 and the second storage 320.

In step S102, the data signal for the sub-pixel of the odd-numbered pixel unit 31 among the above-described LVDS signal and the data signal for the sub-pixel of the even-numbered pixel unit 32 among the above-described LVDS signal are output to the source driver 20 progressively.

For example, under the control of the processor, the data signal for the sub-pixel of the odd-numbered pixel unit 31 among the above LVDS signal is output to the source driver 20 progressively. At the same time, the data signal for the sub-pixel of the even pixel unit 32 among the LVDS signal is output to the source driver 20 progressively.

The following description is made by taking each pixel unit having three sub-pixels with different colors (for example, a red (R) sub-pixel, a green (G) sub-pixel, and a blue (B) sub-pixel) as an example. As shown in FIG. 4, in a case that the first storage 310 is connected to the source driver 20 through three channels of odd-numbered low voltage differential (Mini_LVDS) data lines (0pair, 1pair, 2pair) disposed in parallel, and the second storage 320 is connected to the source driver 20 through three channels of even-numbered low voltage differential (Mini_LVDS) data lines (3pair, 4pair, 5pair) disposed in parallel, the processor 10 may address the data signal (e.g., R10, R11, R12, R13, R14, R15, R16, R17, R30, R31, R32, R33 . . . ; G10, G11, G12, G13, G14, G15, G16, G17, G30, G31, G32, G33 . . . , B10, B11, B12, B13, B14, B15, B16, B17, B30, B31, B32, B33 . . . ) for the sub-pixels of the odd-numbered pixel units 31 among the low voltage differential signal stored in the first storage 310 progressively. Then, each pair (0pair, 1pair or 2pair) of the odd-numbered low voltage differential data lines may receive the data signal for the sub-pixels with one color of the odd-numbered pixel units 31 in a row of pixel units, from the first storage 310 one by one, and to transmit the data signal to the source driver one by one.

For example, for the first row of pixel units, the first channel (0pair) of odd-numbered low voltage differential data line input following data signal to the red sub-pixel R1 of the first column of pixel units from left to right in sequence: R10, R11, R12 R13, R14, R15, R16 and R17. After that, the data signal of R30, R31, R32, R33, R34, R35, R36 and R37 are sequentially input to the red sub-pixel R3 in the third column of pixel units. Similarly, the data signal corresponding to the red sub-pixels of the other odd-numbered pixel units 31 are input in the same manner, until the data signal of R10230, R10231, R10232, R10233, R10234, R10235, R10236, R10237 corresponding to the red sub-pixel R1023 of the last odd-numbered column of pixel unit is input, thereby completing the transmission of data signals for all odd-numbered pixel unit in one row.

At the same time, the processor 10 may address the data signal (e.g., R20, R21, R22, R23, R24, R25, R26, R27, R40, R41, R42, R43 . . . ; G20, G21, G22, G23, G24, G25, G26, G27, G20, G41, G42, G43 . . . , B20, B21, B22, B23, B24, B25, B26, B27, B40, B41, B42, B43 . . . ) for the sub-pixels of the even-numbered pixel units 32 among the low voltage differential signal stored in the second storage 320 progressively. Then, each pair (3pair, 4pair or 5pair) of the even-numbered low voltage differential data lines may receive the data signal for the sub-pixels with one color of the even-numbered pixel units 32 in a row of pixel units, from the second storage 320 one by one, and to transmit the data signal to the source driver one by one.

For example, for the same row of pixel units, the fourth channel (3pair) of even-numbered low voltage differential data line input following data signal to the red sub-pixel R1 of the second column of pixel units from left to right in sequence: R20, R21, R22 R23, R24, R25, R26 and R27. After that, the data signal of R40, R41, R42, R43, R44, R45, R46 and R47 are sequentially input to the red sub-pixel R4 in the fourth column of pixel units. Similarly, the data signal corresponding to the red sub-pixels of the other even-numbered pixel units 32 are input in the same manner, until the data signal of R10240, R10241, R10242, R10243, R10244, R10245, R10246 and R10247 corresponding to the red sub-pixel R1024 of the last even-numbered column of pixel unit is input, thereby completing the transmission of data signals for all even-numbered pixel unit in one row.

It should be noted that the foregoing descriptions are made by taking the red sub-pixel as an example. The writing process of data signals for other sub-pixels is the same as described above and will not be described herein.

It should be noted that the method of driving the display driving circuit 01 mentioned above has the same technical effects as the display driving circuit 01 provided in the foregoing embodiment, and will not be described herein.

In addition, after the step S101 but before step S102, the method may further include following steps.

Figure 8:
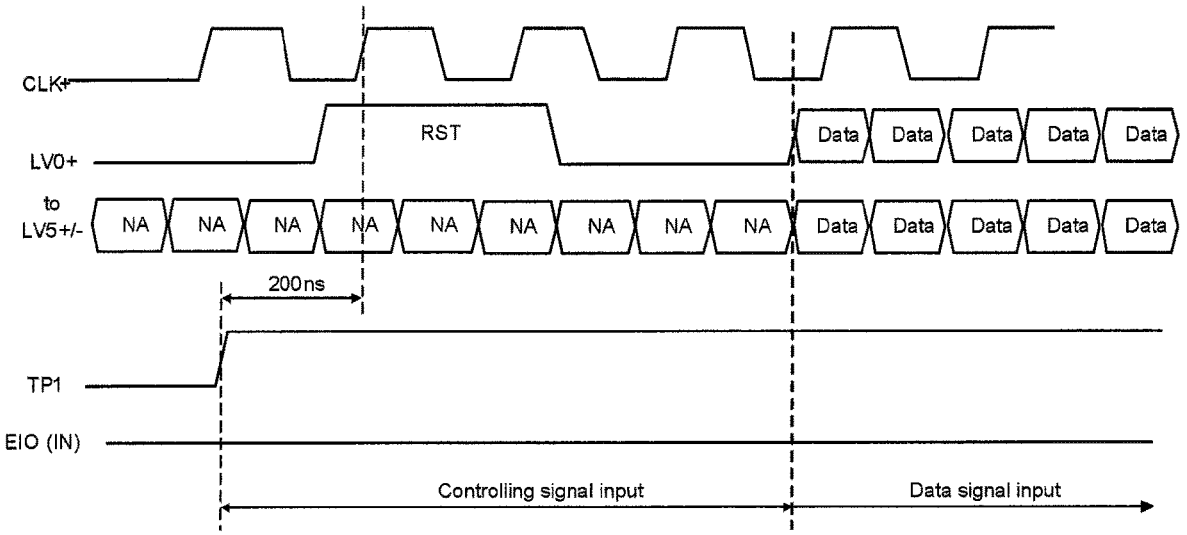
FIG. 8 shows a timing diagram of the method shown in FIG. 7.

As shown in FIG. 8, the processor 10 may output a controlling bit signal for removing the data signal for the sub-pixels in a previous row to the source driver 20 via a channel of low voltage differential (Mini_LVDS) data line, such as, 0pair of Mini_LVDS data line, in response to detection of a controlling signal TP1 for data transmission being at a valid operating level (for example, a high level) for the controlling signal while a flag signal for operation status EIO(IN) being at a valid operating level (for example, a high level).

As shown in FIG. 8, for example, the controlling bit signal includes a resetting signal RST of a high level and a low level after the resetting signal RST.

In addition, after the processor 10 detects that the controlling signal TP1 for data transmission is at a high level, the processor 10 may output the above controlling bit signal after the high level of the controlling signal TP1 for data transmission remains 200 ns, thereby ensuring that the high level of the controlling signal TP1 for data transmission is a stable high level signal rather than a high level signal caused by interference.

In addition, after the processor 10 outputs the above controlling bit signal, the controlling bit signal is output to the source driver 20. In response to the controlling bit signal, the source driver 20 removes the received data signal for the sub-pixels in a previous row, so that the data signal for the sub-pixel in the next row can be accurately written to the source driver 20.

The embodiments of the present disclosure provide a computer device including a processor and a memory. The memory stores a computer program executable by the processor, and when executed by the processor, the computer program causes the processor to implement the method of driving any display driving circuit as discussed above.

It should be noted that the above processor may include an FPGA. In this case, the computer program stored in the memory may be a Very-High-Speed Integrated Circuit Hardware (VHDL). The computer program running on the FPGA means that FPGA adjust the FPGA's own internal circuit according to a real logic circuit generated by VHDL, and operate the adjusted circuit.

The embodiments of the present disclosure provide a computer readable medium storing instructions that, when executed by a processor, implement the method of driving any display driving circuit as described above.

It can be understood that the above embodiments are merely exemplary embodiments used for illustrating the principle of the embodiments of the present disclosure, but the scope of the present disclosure are not limited thereto. For those skilled in the art, various variations and improvements may be made without departing from the spirit and essence of the embodiments of the present disclosure, and these variations and improvements are also considered as the scope of the present disclosure. Therefore, the scope of the present disclosure should be defined by the claims.

We claim:

1. A display driving circuit, comprising:

a source driver;

a processor, electronically connected to the source driver and configured to receive a low voltage differential signal and to output a data signal for sub-pixels of odd-numbered pixel units among the low voltage differential signal and a data signal for sub-pixels of even-numbered pixel units among the low voltage differential signal simultaneously to the source driver progressively; and a first storage electronically connected to the processor and the source driver and configured to store the low voltage differential signal;

wherein the processor is further configured to address the data signal for the sub-pixels of the odd-numbered pixel units or the sub-pixels of the even-numbered pixel units among the low voltage differential signal stored in the first storage progressively.

2. The display driving circuit of claim 1, further comprising a second storage electronically connected to the processor and the source driver, wherein the second storage is configured to store the low voltage differential signal, and the processor is further configured to address the data signal for the sub-pixels of the even-numbered pixel units or the odd-numbered pixel units among the low voltage differential signal stored in the second storage progressively.

3. The display driving circuit of claim 1, wherein each pixel unit comprises three sub pixels with different colors; and the first storage is electronically connected to the source driver through three channels of odd-numbered low voltage differential data lines disposed in parallel;

wherein each of the three channels of odd-numbered low voltage differential data lines is configured to receive the data signal for the sub-pixels with one color of the odd-numbered pixel units in a row of pixel units, from the first storage one by one, and to transmit the data signal to the source driver one by one.

4. The display driving circuit of claim 2, wherein the second storage is electronically connected to the source driver through three channels of even-numbered low voltage differential data lines disposed in parallel;

wherein each of the three channels of even-numbered low voltage differential data lines is configured to receive the data signal for the sub-pixels with one color of the even-numbered pixel units in a row of pixel units, from the second storage one by one, and to transmit the data signal to the source driver one by one.

5. The display driving circuit of claim 1, wherein the processor is implemented as a Field Programmable Gate Array chip.

6. A display driving system, comprising a main driver and the display driving circuit of claim 1;

wherein the main driver is connected to the processor of the display driving circuit through an interface for a low voltage differential signal.

7. A display apparatus comprising the display driving system of claim 6.

8. The display apparatus of claim 7, further comprising a display panel, and the display driving circuit in the display driving system is disposed in a non-display area of the display panel.

9. A method of driving the display driving circuit of claim 1, comprising:

receiving and storing a low voltage differential signal;

outputting a data signal for sub-pixels of odd-numbered pixel units among the low voltage differential signal and a data signal for sub-pixels of even-numbered pixel units among the low voltage differential signal simultaneously to the source driver progressively;

wherein the display driving circuit comprises an odd-numbered low voltage differential data line and an even-numbered low voltage differential data line, and the outputting the data signal to the source driver comprises:

addressing the data signal for sub-pixels of the odd-numbered pixel units among the low voltage differential signal progressively, and outputting, a data signal for the sub-pixels with one color of the odd-numbered pixel units in a row of pixel units, to the source driver through each channel of odd-numbered low voltage differential data line one by one; and simultaneously, addressing the data signal for sub-pixels of even-numbered pixels unit among the low voltage differential signal progressively and outputting, a data signal for the sub-pixels with one color of the even-numbered pixel units in a row of pixel units, to the source driver through each channel of even-numbered low voltage differential data line one by one.

10. The method of claim 9, further comprising, before outputting the data signals to the source driver but after receiving the low voltage differential signal:

outputting, a controlling bit signal for removing the data signal for the sub-pixels in a previous row, to the source driver.

11. The method of claim 9, wherein outputting the controlling bit signal to the source driver in response to detection of a controlling signal for data transmission being at a valid operating level for the controlling signal while a flag signal for operation status being at a valid operating level.

12. A computer device comprising a processor and a memory, the memory storing a computer program executable by the processor, and when executed by the processor, the computer program causes the processor to implement the method of claim 9.

13. A non-transitory computer readable medium storing instructions that, when executed by a processor, implement the method of claim 9.

* * * * *